US008269592B1

(12) United States Patent
McCauley, IV et al.

(10) Patent No.: US 8,269,592 B1
(45) Date of Patent: Sep. 18, 2012

(54) PULSE TRANSFORMER

(75) Inventors: Daniel H. McCauley, IV, Cinnaminson, NJ (US); Richard J. Heinrich, Marlton, NJ (US); Thomas V. Benevides, Acushnet, MA (US); Jack V. Ajoian, Philadephia, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 73 days.

(21) Appl. No.: 12/774,152

(22) Filed: May 5, 2010

(51) Int. Cl.
*H01F 27/28* (2006.01)
*H01F 27/29* (2006.01)
*H01F 17/06* (2006.01)

(52) U.S. Cl. ..... 336/195; 336/175; 336/192

(58) Field of Classification Search ..... 336/172, 336/173, 174, 175, 192, 195
See application file for complete search history.

(56) References Cited

U.S. PATENT DOCUMENTS 2,865,006 A * 12/1958 Sabaroff ..... 333/33
3,725,741 A * 4/1973 Misencik ..... 361/45
4,052,785 A * 10/1977 Duncan ..... 29/605
4,119,914 A * 10/1978 Duncan ..... 455/331
4,222,016 A * 9/1980 Stock et al. ..... 333/24 R
4,437,019 A * 3/1984 Chass ..... 307/83
4,485,361 A 11/1984 Bender
4,584,551 A * 4/1986 Burgher et al. ..... 336/61
4,791,262 A * 12/1988 Ando et al. ..... 219/630
4,868,533 A * 9/1989 Ehrenhalt et al. ..... 336/82
5,216,215 A * 6/1993 Walker et al. ..... 219/630
5,220,297 A * 6/1993 Crowhurst ..... 333/32
5,309,120 A * 5/1994 Koontz ..... 333/32
5,341,281 A * 8/1994 Skibinski ..... 363/39
5,736,854 A * 4/1998 Zuger ..... 324/207.12
5,841,335 A * 11/1998 Onishi et al. ..... 336/170
6,040,753 A * 3/2000 Ramakrishnan et al. ..... 336/223
6,087,916 A * 7/2000 Kutkut et al. ..... 336/61
6,114,924 A * 9/2000 Cain et al. ..... 333/112
6,679,981 B1 * 1/2004 Pan et al. ..... 204/298.06
6,850,142 B2 * 2/2005 Saito et al. ..... 336/192
7,061,355 B2 * 6/2006 Tanaka et al. ..... 336/175
7,796,005 B2 * 9/2010 Blankenship et al. ..... 336/175

OTHER PUBLICATIONS

Milman & Taub, "Pulse, digital and switching waveforms", Chapter 3, pp. 64-110, published 1965, McGraw-Hill Publishing Company.

* cited by examiner

*Primary Examiner* — Mohamad Musleh
*Assistant Examiner* — Joselito Baisa
(74) *Attorney, Agent, or Firm* — Howard IP Law Group, PC

(57) ABSTRACT

A transformer includes a magnetic core through which an insulated electrical first conductor extends to define a turn of winding. The first conductor is tubular, in that it defines a generally axial aperture. A plurality of electrically insulated conductive windings are twisted together to form a bundle, or a pair if only two. The bundle extends through the axial aperture, to define at least an additional turn of winding. The individual conductors of the bundle are stripped of insulation at locations without the aperture of the first conductor.

8 Claims, 5 Drawing Sheets

PULSE TRANSFORMER

BACKGROUND

Pulse transformers for propagating pulses with rapid rise times and fall times are well known, and are described, for example, in the text *Pulse, digital and switching waveforms*, by Milman & Taub, published in 1965 by McGraw-Hill Publishing Company. Pulse transformers utilizing conventional cores and winding techniques, may not provide the necessary coupling and low leakage characteristics required for ultra narrow pulsewidth and high frequency operation with high voltage isolation, as for example isolation to voltages exceeding 10 kV. The difficulty in achieving good coupling and low leakage inductance is compounded by the additional insulation required to stand off the voltage between the transformer primary side at ground potential and the secondary side at the high voltage potential.

To optimize a transformer for passing low distortion rectangular electrical pulse shapes (pulses with fast rise and fall times at relatively constant amplitude), the transformer needs to have low values of leakage inductance and distributed capacitance, together with high open-circuit inductance. Good transient response is needed to maintain the pulse shape at the secondary winding(s) because slow rise times tend to cause switching losses in power transistors and excessive leakage inductance can generate transient ringing.

Leakage inductance is caused by the imperfect coupling of the primary and secondary windings, which in turn generates a leakage flux which does not link with all turns of the windings. The leakage flux acts as another magnetic component, storing and discharging magnetic energy with each frequency cycle of the electrical signal. The leakage flux acts as an inductor in series with each of the primary and secondary windings. This series inductive reactance then causes a frequency sensitive voltage drop (voltage reduction) that increases with frequency, hence constitutes a severe detriment to high-frequency, wide-bandwidth capability.

The physical design of the magnetic core and of the windings of a pulse transformer contribute to the leakage inductance. For high voltage applications, high insulation resistance and high breakdown voltage are required, and in general require even more separation of the windings, which potentially allows more leakage flux to occur. The more the exposure of the windings outside of the core's magnetic flux circuit and the less the proximity of the primary windings to the secondary windings, the more potential exists for leakage flux and the resultant series inductance.

In general, attempting to achieve low leakage inductance is addressed in the prior art by using either flat wide winding materials with minimal insulation or by using interleaved and twisted windings otherwise known as bifilar windings. For windings with a large number of turns, another method is to sectionalize or break up the winding into smaller alternating sections between primary and secondary windings. Neither approach achieves the required coupling since either the magnetic circuit is not sufficiently enveloped or the number of turns is too low for sectionalizing.

The existing design of twisting the primary and secondary windings together in a bifilar fashion on a toroidal magnetic core, as described for example by Milman & Taub, may compromise system performance, as the coupling may be less than desired, and leakage inductance may be excessive for the required performance at the frequencies and pulse shapes required.

Improved pulse transformers are desired.

SUMMARY

A transformer comprises a magnetic core defining first and second apertures which extend therethrough. An electrical first conductor has a tubular shape, and extends through the first and second apertures. A twisted pair of insulated second and third conductors extends through the first conductor. The first conductor may be insulated where it passes through the core.

A transformer comprises a magnetic core defining first and second apertures extending therethrough. The first aperture defines first and second ends, and the second aperture defines first and second ends. The transformer further includes an electrical first conductor defining at least a local axis of elongation and also defining first and second ends. The first conductor extends through the first and second apertures in such a manner that the first end of the first conductor lies adjacent to the second end of the first conductor. The first conductor may be insulated at locations near where it passes through the first and second apertures. The first conductor has a generally tubular shape defining an opening extending generally parallel with the axis of elongation from the first to the second end of the first conductor. The transformer also includes a twisted pair of first and second insulated conductors, longer than the length of the first conductor. The twisted pair extends through the opening of the first conductor, at least from the first end to the second end of the opening of the first conductor. Each end of the first insulated conductor lacks, or is stripped of, insulation, and each end of the second insulated conductor lacks, or is stripped of, insulation at a location without the opening of the first conductor. In a particular embodiment, the apertures extending through the core are mutually parallel, and the first aperture defines first and second ends, and the second aperture defines first and second ends. The first ends of the first and second apertures are mutually adjacent, and the second ends of the first and second apertures being mutually adjacent. In one version, the magnetic core defines mutually parallel first and second planes, with the first apertures being defined in the first plane and the second apertures being defined in the second plane. The first and second ends of the first conductor may be physically and electrically connected to connection leads, and the connection leads may be, when the first conductor is a braided conductor, extensions of the braid of the braided conductor. In another version, the aperture extending through the first conductor may contain a plurality, greater than two, of electrical conductors twisted together.

A transformer according to another aspect of the disclosure comprises a magnetic core defining first and second apertures extending therethrough. The first aperture defines first and second ends, and the second aperture defines first and second ends. The transformer includes an electrical first conductor defining an axis of elongation and also defining first and second ends. The first conductor extends into the first end of the first aperture and exits from the second end of the first aperture, and extends from the second end of the first aperture to the second end of the second aperture, and extends into or enters the second end of the second aperture, and exits from the first end of the second aperture. The first conductor has a generally tubular shape defining an opening extending generally parallel with the axis of elongation from the first to the second end of the first conductor. The first conductor may be insulated near the region in which it passes through the first and second apertures. The transformer also comprises a twisted conductor pair, longer than the length of the first conductor, of first and second insulated conductors. The twisted pair of conductors extends at least from the first end to the second end of the opening of the first conductor. Each end of the first and second insulated conductors lacks or is without insulation at a location without the first conductor.

DETAILED DESCRIPTION

Magnetic coupling can be varied through several parameters including transformer core material or size, winding material, number of winding turns or winding wire size and can be directly improved by the close proximity of the primary windings to the core, close proximity of the secondary windings to the core, and close proximity of the primary to secondary windings.

In order to improve the magnetic coupling on a low-turns-ratio, high-voltage-isolation pulse transformer, both primary and secondary windings require maximum envelopment by the core. A multi-aperture core was used which provided two openings into an elongated ferrite core. See FIG. 1 showing the assembled core and winding configuration. This type of core is more commonly used for forming inductors with a single winding for electromagnetic interference Suppression. If another type of core were to be used, such as a toroid, very little of the windings would be enveloped by the core and higher leakage flux could occur.

The next parameter requiring improvement is to maximize coupling between the primary and secondary windings. In order to accomplish maximum coupling, a coaxial winding technique was used. Coaxial cable is primarily used to eliminate magnetic fields around the cable by surrounding an inner conductor with current flowing in one direction with an outer conductor carrying the return current in the opposite direction. This creates magnetic fields that cancel each other due to the superior coupling of the inner to the outer conductors. If one of the currents is reversed such that both currents flow in the same direction and coupling is still the same, the magnetic fields now add in a near ideal condition.

Figure 1B:
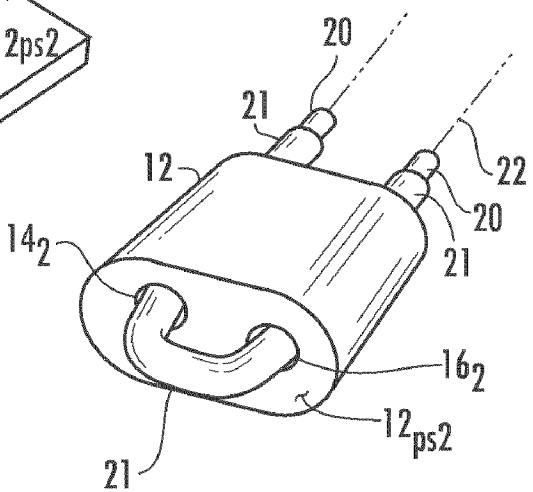
FIGS. 1A and 1B are simplified perspective or isometric front and rear views, respectively, of a portion of a printed-circuit board supporting and providing interconnections for a transformer according to an aspect of the disclosure.
Figure 1A:
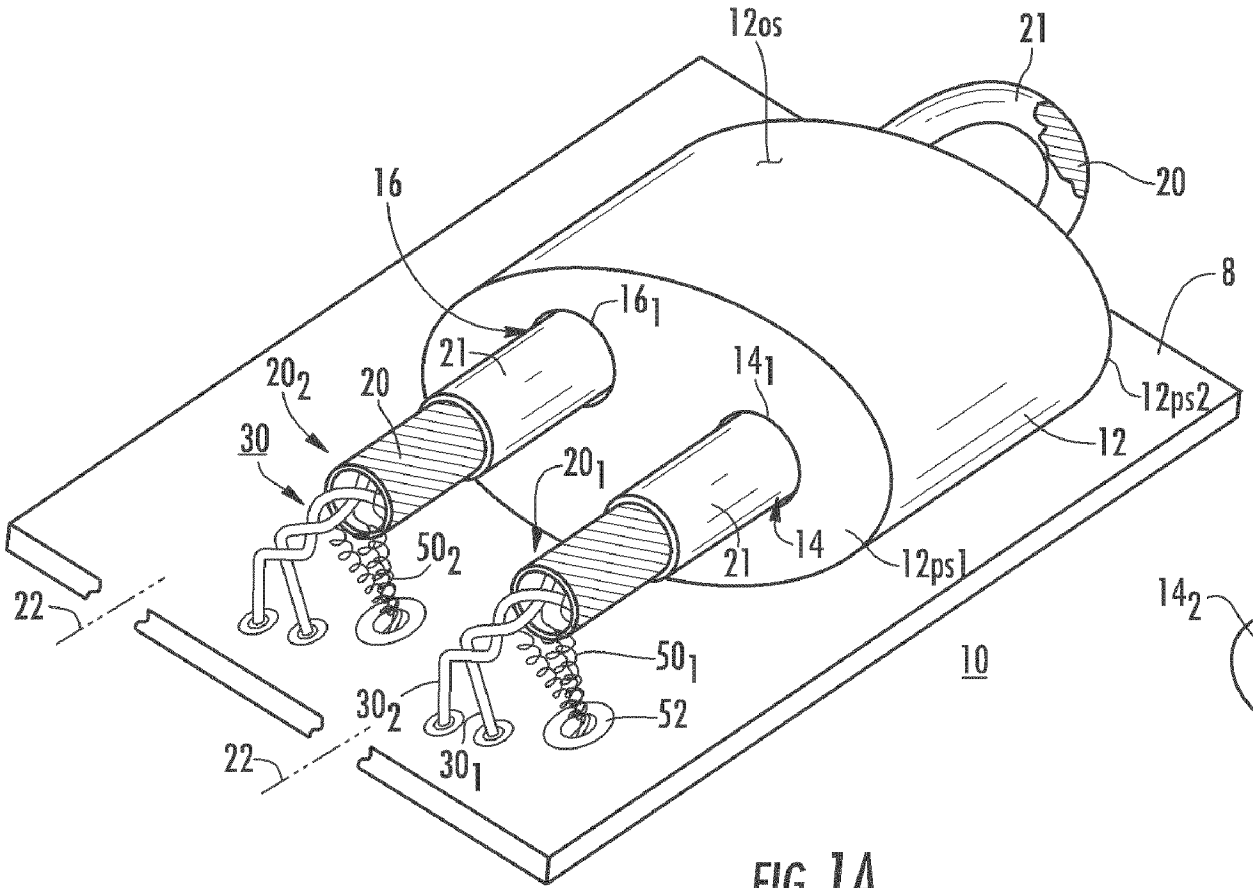

To create a high voltage coaxial primary and secondary winding, a low voltage coaxial cable was used and the inner conductor and dielectric removed, and replaced with the properly rated high voltage wire. The modified coaxial cable was then routed through the multi-aperture core as shown in FIGS. 1A and 1B. The transformer assembly now achieves both maximum envelopment of the coaxial windings, creating a design that places both the windings and core in close proximity for optimized coupling and low leak inductance. The pulse performance has been greatly improved over an existing toroidal design.

FIGS. 1A and 1B together illustrate a simplified perspective or isometric view of a portion of a printed-circuit board 8 supporting and providing interconnections for a transformer 10 according to an aspect of the disclosure. In FIGS. 1A and 1B, the transformer 10 includes a magnetic core 12 defining a curved outer surface portion 12*os*, and also defining mutually parallel, generally planar portions 12*ps*1 and 12*ps*2. Magnetic core 12 defines a first through hole or aperture 14, which may have a circular cross-section. Aperture 14 defines a first end $\mathbf{14}_1$ in planar face or surface 12*ps*1 and a second end $\mathbf{14}_2$ in planar face or surface 12*ps*2. Magnetic core 12 also defines a second through hole or aperture 16, which may have a circular cross-section. Aperture 16 defines a first end $\mathbf{16}_1$ in planar face or surface 12*ps*1 and a second end $\mathbf{16}_2$ in planar face or surface 12*ps*2. In one embodiment, a "binocular" magnetic core may be used.

Figure 1C:
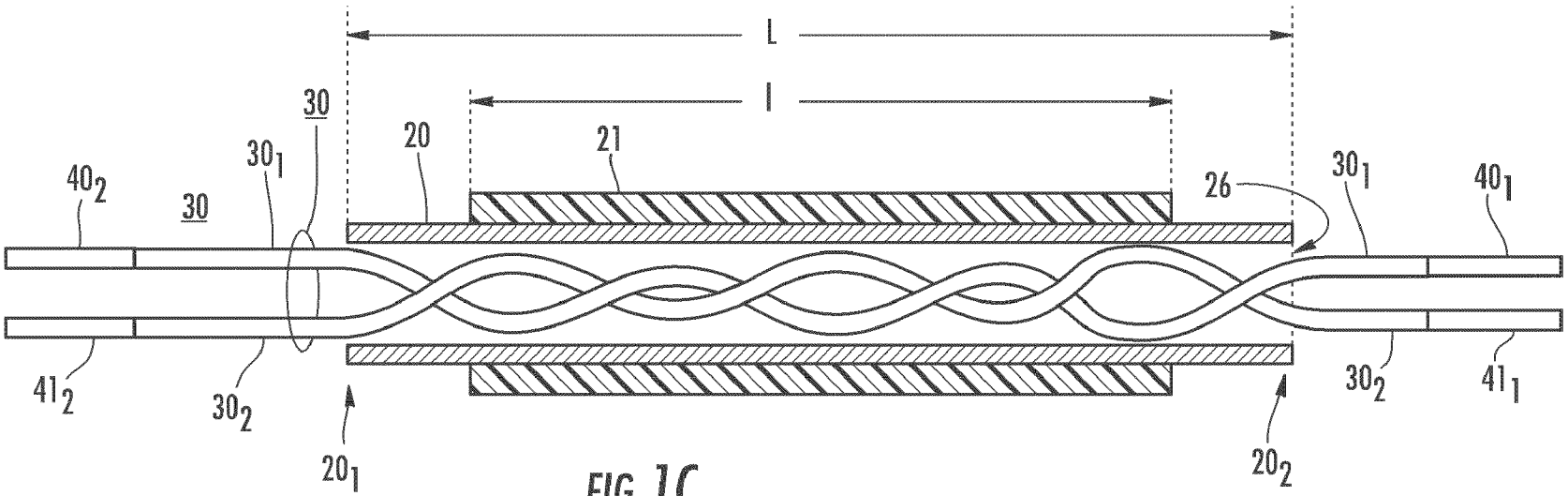
FIG. 1C is a simplified longitudinal cross-sectional view of the physical arrangement of certain windings of the transformer of FIGS. 1A and 1B.

An electrical conductor 20 defines first and second ends $\mathbf{20}_1$ and $\mathbf{20}_2$, respectively. Conductor 20 has a generally tubular form, so that it defines an opening or passage 26 which generally follows a local axis 22 of elongation of conductor 20. The term "local" axis allows for curvature of the axis to follow a bent or deviated course. Conductor 20 may be a braided conductor, as known in the art. Conductor 20 is surrounded, over at least a portion of its length, by a layer 21 of electrical insulation or dielectric material. FIG. 1C is a longitudinal cross-section of conductor 20 together with its insulation and a twisted pair, laid out straight. The length of conductor 20 can be seen to be L and the length of surrounding insulation 21 is k. Conductor 20, together with its insulation 21, extends through apertures $\mathbf{14}_1$ and $\mathbf{14}_2$, with ends $\mathbf{20}_1$ and $\mathbf{20}_2$ on the same side of the magnetic core 12, which is to say with ends $\mathbf{20}_1$ and $\mathbf{20}_2$ adjacent core surface 12*ps*1. Insulation 21 may be coextensive with the length of conductor 20, if desired. Insulation 21 must be long enough to provide electrical isolation between conductor 20 and magnetic core 12 over at least that length of conductor 20 extending through apertures 14 and 16. As illustrated in FIGS. 1A and 1B, the length of insulation 21 is somewhat greater than the minimum, to prevent conduction in the vicinity of the apertures $\mathbf{14}_1$ and $\mathbf{16}_1$. FIG. 1A shows a portion of the insulation 21 cut away to reveal the braided conductor 20.

The position of conductor 20 (and its insulation 21) in the apertures of core 20 as illustrated in FIGS. 1A and 1B may be viewed as the first conductor 20 and insulation 21 extending into the first end $\mathbf{14}_1$ of the first aperture 14 and exiting from the second end $\mathbf{14}_2$ of the first aperture 14, and from said second end $\mathbf{14}_2$ of the first aperture (14) entering the second end $\mathbf{16}_2$ of the second aperture 16 and exiting from the first end $\mathbf{16}_1$ of the second aperture 16.

Conductor 20 of FIGS. 1A and 1B may be viewed as defining a single magnetic "turn" of winding of transformer 10. In order to take advantage of the transformer, there must be some way to connect to the two ends $\mathbf{20}_1$ and $\mathbf{20}_2$ of conductor 20. As illustrated, the ends of conductor 20 are connected by way of "pigtail" electrical conductors or connections $\mathbf{50}_1$ and $\mathbf{50}_2$ to plated-through terminals, such as terminal 52, on the upper surface of printed-circuit board 8. In the case in which electrical conductor 20 is a braided hollow conductor, the pigtail conductors $\mathbf{50}_1$ and $\mathbf{50}_2$ may be made by either slitting or unbraiding the conductor 20 at a location near the ends $\mathbf{20}_1$ and $\mathbf{20}_2$, and twisting the braid thus freed into pigtail form. Solder is often used to make the braid pigtail more rigid, so that it can be inserted into the plated-through apertures on the printed-circuit board.

Figure 2A:
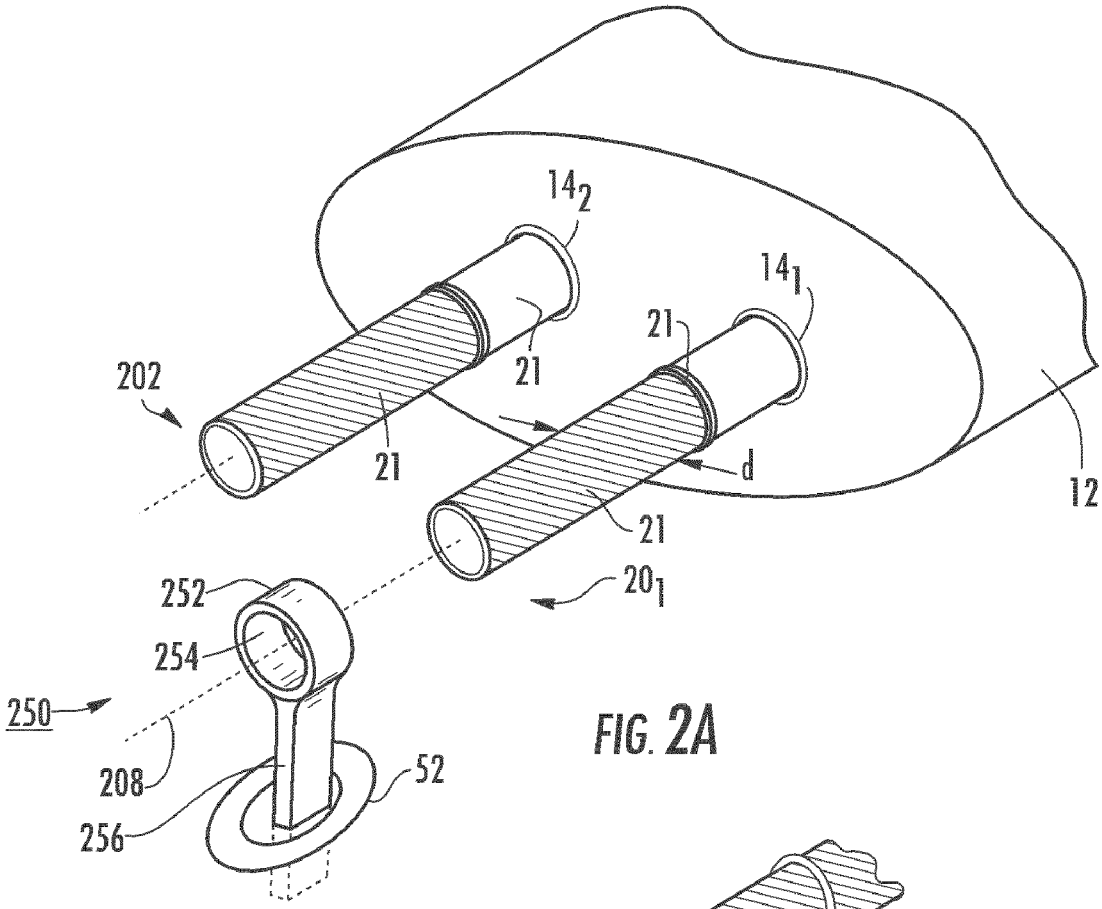
FIG. 2A is a simplified perspective or isometric view of a pigtail connection lug which can be used with a braided conductor.
Figure 2B:
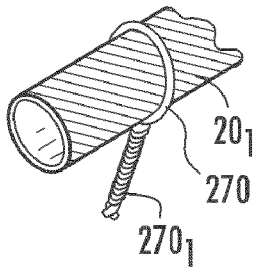
FIG. 2B illustrates the use of a length of conductive wire to form a pigtail.

As an alternative to directly using the braid of a braided conductor 20 of FIGS. 1A, 1B to define the pigtail, or in the case in which conductor 20 is a nonbraided conductive tube, an alternative pigtail connection can be used as illustrated in FIG. 2A. Elements of FIG. 2A corresponding to FIGS. 1A and 1B are designated by the same reference numerals. In FIG. 2, an electrically conductive pigtail connector is generally designated 250. Pigtail connector 250 includes a socket portion 252 defining a cylindrical opening 254 dimensioned to accommodate the diameter d of conductor 20. As indicated by the axis 208, the socket portion 252 is slipped over the end of the conductor 20. Pigtail connector 250 also includes an integral or monolithically attached "lead" portion 256 which is available to extend into the aperture of plated-through hole 52. The connection of the end of conductor 20 in socket portion 252 may be soldered or fused to make good connection, and the connection of the lead portion 256 to the plated-through hole 52 may be accomplished in the fashion usual to printed-circuit board handling. Other types of connections are well known in the art, and may also be used. One such type of connection is a pigtail made from a turn of conductor about the end of conductor $\mathbf{20}_1$, the ends of which are twisted, as illustrated by wire 270 wound about the end of conductor $\mathbf{20}_1$, with its ends twisted to form pigtail $\mathbf{270}_1$.

According to an aspect of the disclosure, an insulated twisted conductor pair 30 extends through opening 26, which extends through the "center" of winding conductor 20. The twisting tends to improve the coupling between the wires of the twisted pair and to reduce the distributed capacitance between the inside of conductor 20 and the wires of the twisted pair. FIG. 1C is a simplified, cut-away representation of the disposition in conductor 20 of the twisted pair 30 of conductors, laid out straight. In order to make connections to the conductors $\mathbf{40}_1$ and $\mathbf{40}_2$ of insulated twisted pair 30 of FIG. 1C, the twisted pair must be longer than the overall length L of conductor 20, otherwise the ends of the insulated twisted pair conductors 301 and would tend to be "inside" conductor 20 and thus at least difficult, if not impossible, to access. Thus, the length of insulated insulated twisted pair 30 is selected to be long enough to make the desired connections to the conductors $\mathbf{40}_1$ and $\mathbf{40}_2$ of the twisted pair. Those ends $\mathbf{40}_1$ and $\mathbf{40}_2$ of conductor which are free of insulation can be formed to fit into a pattern of plated-through apertures in a printed-circuit board, as suggested by FIG. 1A.

Figure 1D:
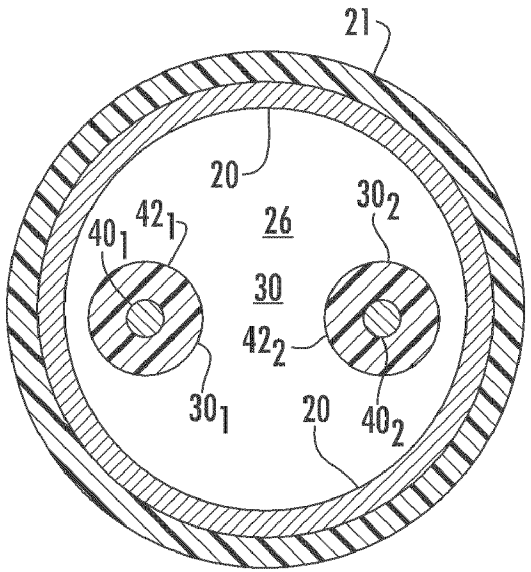
FIG. 1D is a cross-section taken transverse to the length of certain windings, showing the electrical insulation.

FIG. 1D illustrates the insulated conductors of the twisted pair 30 of FIG. 1C. As illustrated, insulated conductor $\mathbf{30}_1$ includes a conductor $\mathbf{40}_1$ surrounded by a layer $\mathbf{42}_1$ of insulation, and insulated conductor $\mathbf{30}_2$ includes a conductor $\mathbf{40}_2$ surrounded by a layer $\mathbf{42}_2$ of insulation. The layer of insulation surrounding each wire conductor of twisted pair 30 must be sufficient to meet the isolation requirements. The transverse dimension of the aperture 26 extending through winding 20 must be large enough to accommodate the number of twisted wires and the insulation associated with each.

It should be noted that the terms "between," "across," and other terms such as "parallel" have meanings in an electrical context which differ from their meanings in the field of mechanics or in ordinary parlance. More particularly, the term "between" in the context of signal or electrical flow relating to two separate devices, apparatuses or entities does not relate to physical location, but instead refers to the identities of the source and destination of the flow. Thus, flow of signal "between" A and B refers to source and destination, and the flow itself may be by way of a path which is nowhere physically located between the locations of A and B. The term "between" can also define the end points of the electrical field extending "across" or to points of differing voltage or potential, and the electrical conductors making the connection need not necessarily lie physically between the terminals of the source. Similarly, the term "parallel" in an electrical context can mean, for digital signals, the simultaneous generation on separate signal or conductive paths of plural individual signals, which taken together constitute the entire signal. For the case of current, the term "parallel" means that the flow of a current is divided to flow in a plurality of separated conductors, all of which are physically connected together at disparate, spatially separated locations, so that the current travels from one such location to the other by plural paths, which need not be physically parallel.

In addition, discussions of circuits necessarily describe one element at a time, as language is understood in serial time. Consequently, a description of two interconnected elements may describe them as being in "series" or in "parallel," which will be true for the two elements described. However, further description of the circuit may implicate other interconnected devices, which when connected to the first two devices may result in current flows which contradict the "series" or "parallel" description of the original two devices. This is an unfortunate result of the limitations of language, and all descriptions herein should be understood in that context.

Also, the term "coupled" as used herein includes electrical activity extending from one element to another element either by way of one or more intermediary elements or in the absence of any intermediary element.

Figure 3:
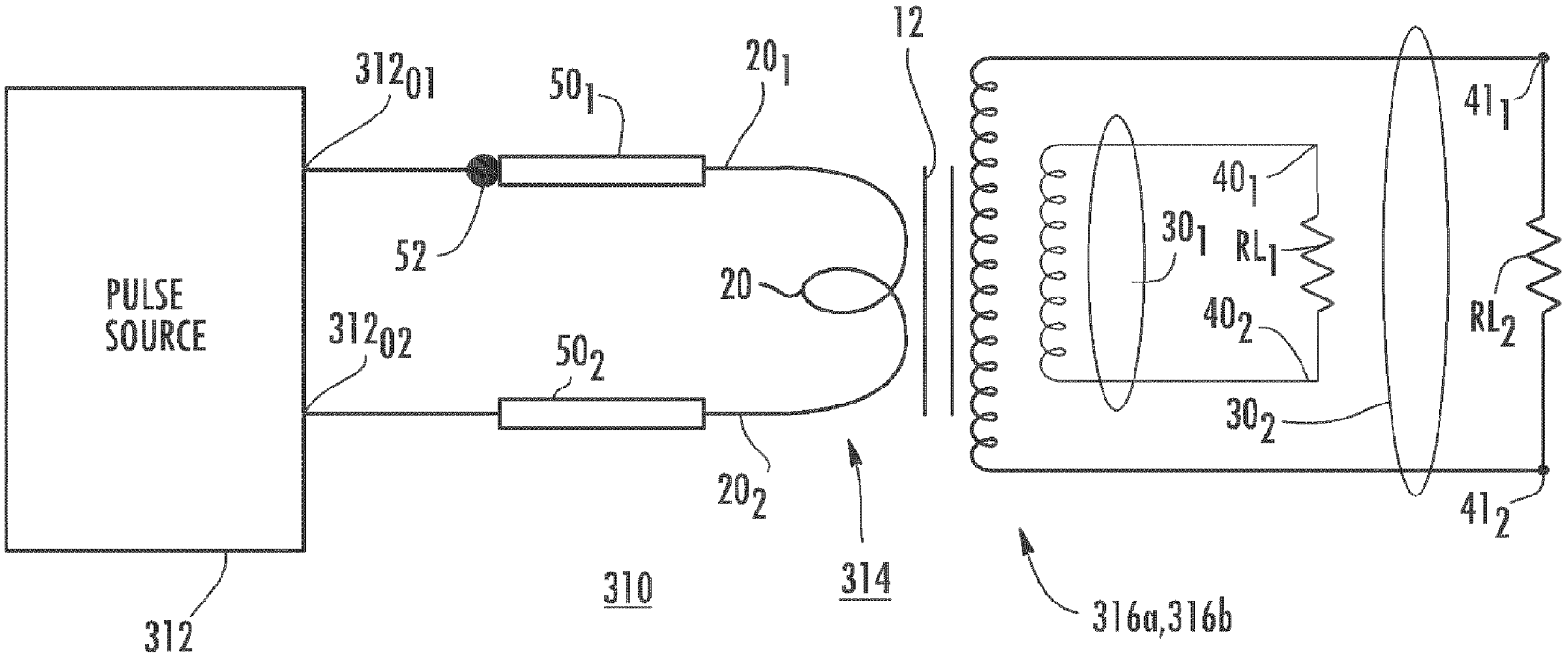
FIG. 3 is a simplified schematic diagram illustrating one possible way to connect into a circuit a transformer according to an aspect of the disclosure.

FIG. 3 is a simplified schematic diagram illustrating a way to use the transformer of FIGS. 1A, 1B. In FIG. 3, a pulse source 312 produces pulses "between" its output ports 312*o*1 and 312*o*2. Port 312*o*1 is connected by way of plated terminal 50 to pigtail $\mathbf{50}_1$. Port 312*o*2 is connected to pigtail $\mathbf{50}_2$. Pigtails 501 and 502 convey the pulse to the ends $\mathbf{20}_1$ and $\mathbf{20}_2$ of hollow conductor 20, constituting the energization of the primary winding 314 (conductor 20 in this case). The secondary windings of transformer 310 of FIG. 3 are designated generally as 316*a* and 316*b*. Conductor $\mathbf{30}_1$ is connected at its exposed conductors $\mathbf{40}_1$ and $\mathbf{40}_2$ to a load illustrated as a resistance RL1. Similarly, conductor $\mathbf{30}_2$ is connected at its exposed conductors 411 and 412 to a load illustrated as a resistance RL2.

Figure 4:
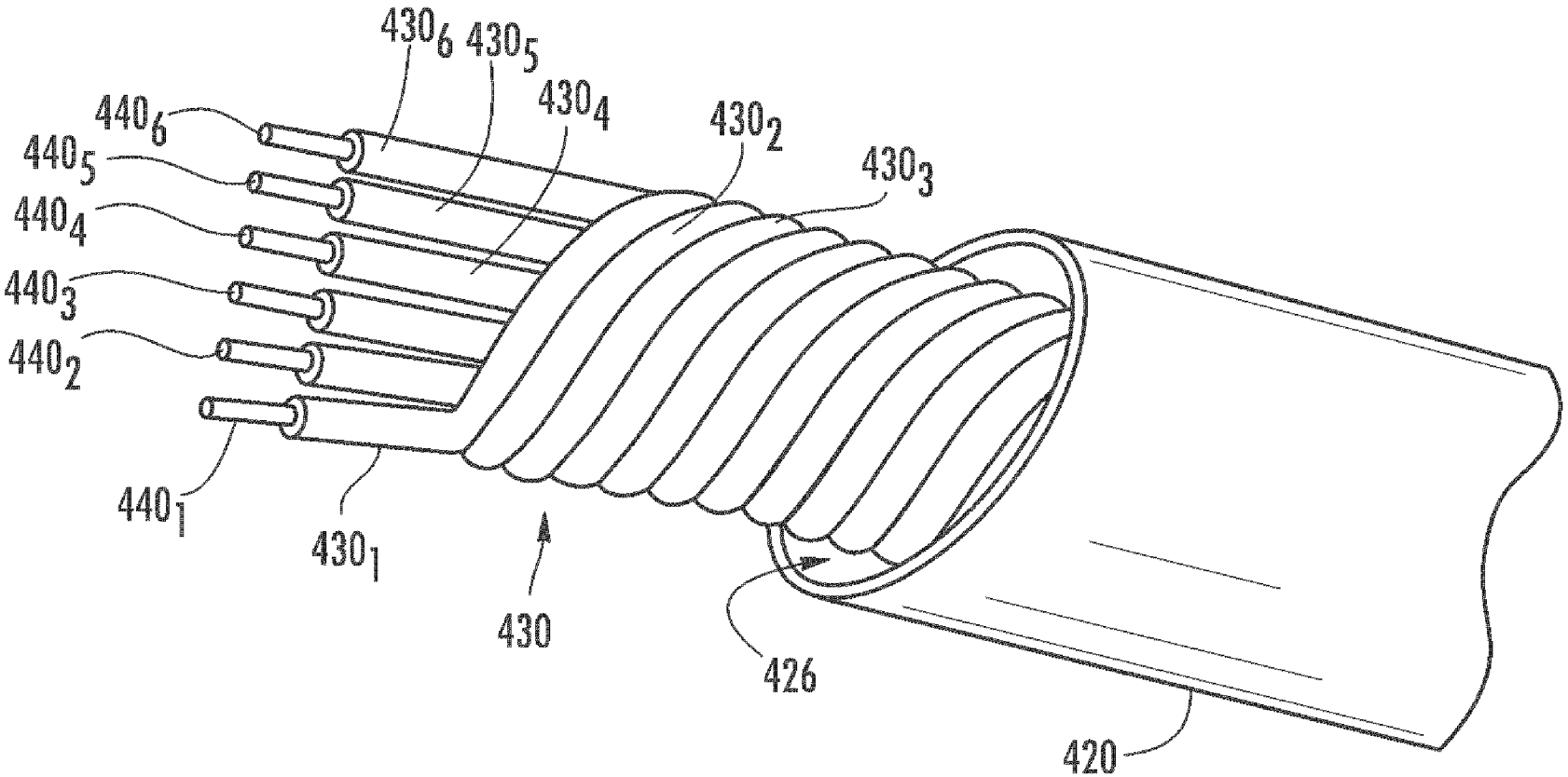
FIG. 4 is an illustration of a hollow transformer winding according to an aspect of the disclosure in which the aperture accommodates a plurality of insulated conductors which are wound together to form a bundle.

Other embodiments of the disclosed transformer will be apparent to those skilled in the art. For example, the hollow conductive winding, illustrated as 420 in FIG. 4, may have an aperture 426 dimensioned to accommodate N twisted-together insulated conductors 430. In FIG. 4, the number N is selected to be six (6), and the insulated conductors are designated $\mathbf{430}_1$, $\mathbf{430}_2$, $\mathbf{430}_3$, $\mathbf{430}_4$, $\mathbf{430}_5$, and $\mathbf{430}_6$. The corresponding exposed conductors are designated $\mathbf{440}_1$, $\mathbf{440}_2$, $\mathbf{440}_3$, $\mathbf{440}_4$, $\mathbf{440}_5$, and $\mathbf{440}_6$.

A transformer (10) according to an aspect of the disclosure comprises a magnetic core (12) defining first (14) and second (16) apertures extending therethrough. The first aperture (14) defines first ($\mathbf{14}_1$) and second ($\mathbf{14}_2$) ends, and the second (16) aperture defines first ($\mathbf{16}_1$) and second ($\mathbf{16}_2$) ends. The transformer (10) further includes an electrical first conductor (20) defining at least a local axis (22) of elongation and also defining first ($\mathbf{20}_1$) and second ($\mathbf{20}_2$) ends. The first conductor (20) may be electrically insulated over a portion of its length. The first conductor (20) extends through the first (14) and second (16) apertures in such a manner that the first ($\mathbf{20}_1$) end of the first conductor (20) lies adjacent to the second end ($\mathbf{20}_2$) of the first conductor (20). The first conductor (20) has a generally tubular shape defining an opening (26) extending generally parallel with the axis (22) of elongation from the first ($\mathbf{24}_1$) to the second ($\mathbf{24}_2$) end of the first conductor (20). The transformer (10) also includes a twisted pair (30) of first ($\mathbf{30}_1$) and second ($\mathbf{30}_2$) insulated conductors, longer than the length (L) of the first conductor (20). The twisted pair (30) extends through the opening (26) of the first conductor (20), at least from the first end ($\mathbf{20}_1$) to the second end ($\mathbf{20}_2$) of the opening (26) of the first conductor (20). Each end ($\mathbf{40}_1$, $\mathbf{40}_2$) of the first ($\mathbf{30}_1$) insulated conductor lacks, or is stripped of, insulation, and each end ($\mathbf{41}_1$, $\mathbf{41}_2$) of the second ($\mathbf{30}_2$) insulated conductor lacks, or is stripped of, insulation at a location without the opening (26) of the first conductor (20). In a particular embodiment, the apertures (14, 16) extending through the core (12) are mutually parallel, and the first (14) aperture defines first ($\mathbf{14}_1$) and second ($\mathbf{14}_2$) ends, and the second aperture (16) defines first ($\mathbf{16}_1$) and second ($\mathbf{16}_2$) ends. The first ends ($\mathbf{14}_1$, $\mathbf{16}_1$) of the first (14) and second (16) apertures are mutually adjacent, and the second ends ($\mathbf{14}_2$, $\mathbf{16}_2$) of the first and second apertures being mutually adjacent. In one version, the magnetic core (12) defines mutually parallel first (12*ps*1) and second (12*ps*2) planes, with the first apertures ($\mathbf{14}_1$ $\mathbf{16}_1$) being defined in the first plane (12*ps*1) and the second apertures ($\mathbf{14}_2$ $\mathbf{16}_2$) being defined in the second plane (12*ps*2). The first ($\mathbf{20}_1$) and second ($\mathbf{20}_2$) ends of the first conductor may be physically and electrically connected to connection leads (501, 502; 270), and the connection leads may be, when the first conductor (20) is a braided conductor, extensions of the braid of the braided conductor. In another version, the aperture (26) extending through the first conductor (20) may contain a plurality, greater than two, of electrical conductors twisted together (430). Any of the windings may be viewed as being a primary winding and the others as secondary.

A transformer (10) according to another aspect of the disclosure comprises a magnetic core (12) defining first (14) and second (16) apertures extending therethrough. The first aperture (14) defines first ($\mathbf{14}_1$) and second ($\mathbf{14}_2$) ends, and the second (16) aperture defines first ($\mathbf{16}_1$) and second ($\mathbf{16}_2$) ends. The transformer includes an electrical first conductor (20) defining an axis (22) of elongation and also defining first ($\mathbf{20}_1$) and second ($\mathbf{20}_2$) ends. The first conductor (20) may be electrically insulated over at least a portion of its length. The first conductor (20) extends into the first end ($\mathbf{14}_1$) of the first aperture (14) and exits from the second end ($\mathbf{14}_2$) of the first aperture (14), and extends from the second end ($\mathbf{14}_2$) of the first aperture (14) to the second end ($\mathbf{16}_2$) of the second aperture (16), and extends into or enters the second end ($\mathbf{16}_2$) of the second aperture (16), and exits from the first end ($\mathbf{16}_1$) of the second aperture (16). The first conductor (20) has a generally tubular shape defining an opening (26) extending generally parallel with the axis (22) of elongation from the first ($\mathbf{24}_1$) to the second ($\mathbf{24}_2$) end of the first conductor (20). The transformer (10) also comprises a twisted conductor pair (30), longer than the length of the first conductor, of first ($\mathbf{30}_1$) and second ($\mathbf{30}_2$) insulated conductors. The twisted pair of conductors (30) extends at least from the first end ($\mathbf{26}_1$) to the second end ($\mathbf{26}_2$) of the opening (26) of the first conductor (20). Each end of the first ($\mathbf{30}_1$) and second ($\mathbf{30}_2$) insulated conductors lacks insulation, or is absent insulation, or is without insulation at a location without the first conductor (12).

What is claimed is:

1. A transformer comprising:

an elongated magnetic core defining first and second apertures extending therethrough;

an electrical first conductor extending through said first and second apertures, said first conductor having a tubular shape; and a twisted pair of insulated second and third conductors, said twisted pair extending through said first conductor;

wherein the elongated magnetic core substantially envelops the electrical first conductor and the twisted pair of insulated second and third conductors, thereby reducing transformer leakage flux; and wherein said first conductor is electrically insulated from said magnetic core.

2. A transformer comprising:

an elongated magnetic core defining first and second apertures extending therethrough, said first aperture defining first and second ends, and said second aperture defining first and second ends;

an electrical first conductor defining an axis of elongation and also defining first and second ends, said first conductor extending through said first and second apertures in such a manner that said first end of said first conductor lies adjacent to said second end of said first conductor, said first conductor having a generally tubular shape defining an opening extending generally parallel with said axis of elongation from said first to said second end of said first conductor;

a twisted pair, longer than the length of said first conductor, of first and second insulated conductors, said twisted pair extending at least from said first end to said second end of said opening of said first conductor, each end of said first and second insulated conductors being without insulation at a location without said opening of said first conductor; and a layer of insulation surrounding said first conductor at least in those regions in which said first conductor extends through said first and second apertures;

wherein the elongated magnetic core substantially envelops the electrical first conductor and the twisted pair of insulated second and third conductors, thereby reducing transformer leakage flux.

3. A transformer according to claim 2, wherein said apertures extending through said core are mutually parallel, and wherein each of said first and second apertures defines first and second ends, said first ends of said first and second apertures being mutually adjacent, and said second ends of said first and second apertures being mutually adjacent.

4. A transformer according to claim 2, wherein said core defines mutually parallel first and second planes, with said first apertures being defined in said first plane and said second apertures being defined in said second plane.

5. A transformer according to claim 2, wherein said first and second ends of said first conductor are physically and electrically connected to connection leads.

6. A transformer according to claim 5, wherein said first conductor is a braided conductor, and said connection leads at said first and second ends of said first conductor are extensions of said braid of said braided conductor.

7. A transformer according to claim 5, wherein said first conductor is a braided conductor, and said connection leads at said first and second ends of said first conductor are pigtail connections.

8. A transformer comprising:

an elongated magnetic core defining first and second apertures extending therethrough, said first aperture defining first and second ends, and said second aperture defining first and second ends;

an electrical first conductor defining an axis of elongation and also defining first and second ends, said first conductor extending into said first end of said first aperture and exiting from said second end of said first aperture, and from said second end of said first aperture entering said second end of said second aperture and exiting from said first end of said second aperture, said first conductor having a generally tubular shape defining an opening extending generally parallel with said axis of elongation from said first to said second end of said first conductor;

a twisted pair, longer than the length of said first conductor, of first and second insulated conductors, said twisted pair extending at least from said first end to said second end of said opening of said first conductor, each end of said first and second insulated conductors being without insulation at a location without said first conductor; and a layer of electrical insulation extending over the exterior of said first conductor over at least a portion of its length;

wherein the elongated magnetic core substantially envelops the electrical first conductor and the twisted pair of insulated second and third conductors, thereby reducing transformer leakage flux.

* * * * *